United States Patent [19]

Leathley et al.

[11] 3,952,456

[45] Apr. 27, 1976

[54] GRINDING MACHINE

[75] Inventors: Burton R. Leathley; Clifford L. Garrison; Rollo L. Garrison; Richard F. Snyder, all of Adrian, Mich.

[73] Assignee: Oliver Instrument Company, Adrian, Mich.

[22] Filed: Feb. 7, 1975

[21] Appl. No.: 548,156

[52] U.S. Cl. ..... 51/56 R; 51/2 K; 51/165.9

[51] Int. Cl.[2] ..... B24B 7/00

[58] Field of Search ..... 51/2 K, 2 UA, 34 R, 51/34 D, 34 J, 56, 165.85, 165.87, 165.9

[56] References Cited

UNITED STATES PATENTS

| | | | |
|---|---|---|---|
| 2,629,972 | 3/1953 | Garrison | 51/56 |
| 2,874,517 | 2/1959 | Markle | 51/34 R |
| 3,136,093 | 6/1964 | Deprez | 51/56 X |
| 3,146,551 | 9/1964 | Carlsen | 51/56 X |

*Primary Examiner*—Al Lawrence Smith
*Assistant Examiner*—Gary L. Smith
*Attorney, Agent, or Firm*—Harry O. Ernsberger

[57] ABSTRACT

The disclosure embraces a method of and apparatus or grinding machine particularly for grinding or sharpening the teeth of rotary cutters or cutting tools, the apparatus including a reciprocable ram mounting a rotatable grinding wheel, a vertically movable work or cutter supporting means and a work or cutter indexing means, the reciprocable ram, the feeding means for the grinding wheel, the movable cutter supporting means and the cutter indexing means each being driven or actuated by a hydraulically actuated rotary motor individual to each of these instrumentalities and controlled by means operable to effect automatically the grinding of all of the teeth of a cutter or cutting tool.

11 Claims, 14 Drawing Figures

GRINDING MACHINE

The invention relates to improvements in grinding machines and more particularly to a grinding machine or apparatus for grinding or removing metal from form cutters or multitoothed cutting tools in which the grinding of the cutters or cutting tools is held to critical dimensions and wherein instrumentalities of the grinding machine are activated by accurately controlled hydraulic motor means. Cutter grinders have been devised and used for grinding teeth of rotatable tools or multitoothed cutters by manually reciprocating a ram carrying a grinding wheel and wherein the tool or cutter support and cutter feeding means are manually actuated. A grinding machine of this character is illustrated in Garrison U.S. Pat. No. 2,629,972.

The present invention embraces a grinding machine or apparatus for grinding or sharpening cutting tools or multitoothed cutters wherein hydraulic rotary motors actuate instrumentalities or components of the grinding machine providing effective and precision operation of such instrumentalities or components.

An object of the invention resides in the provision of a method of and apparatus for actuating instrumentalities of a grinding machine by hydraulic rotary motors and wherein the hydraulic motors are precision controlled by electrically-operated means.

Another object of the invention resides in a grinding machine particularly for grinding multitoothed cutters wherein the grinding wheel is mounted by a reciprocable ram actuated by a hydraulic rotary motor and the work support, the indexing mechanism for the cutter and the feed of the grinding wheel are actuated by individual hydraulic rotary motors in conjunction with controls for the hydraulic motors to effect precision grinding of a cutter.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawing of a form of the invention, which may be preferred, in which.

Figure 1:
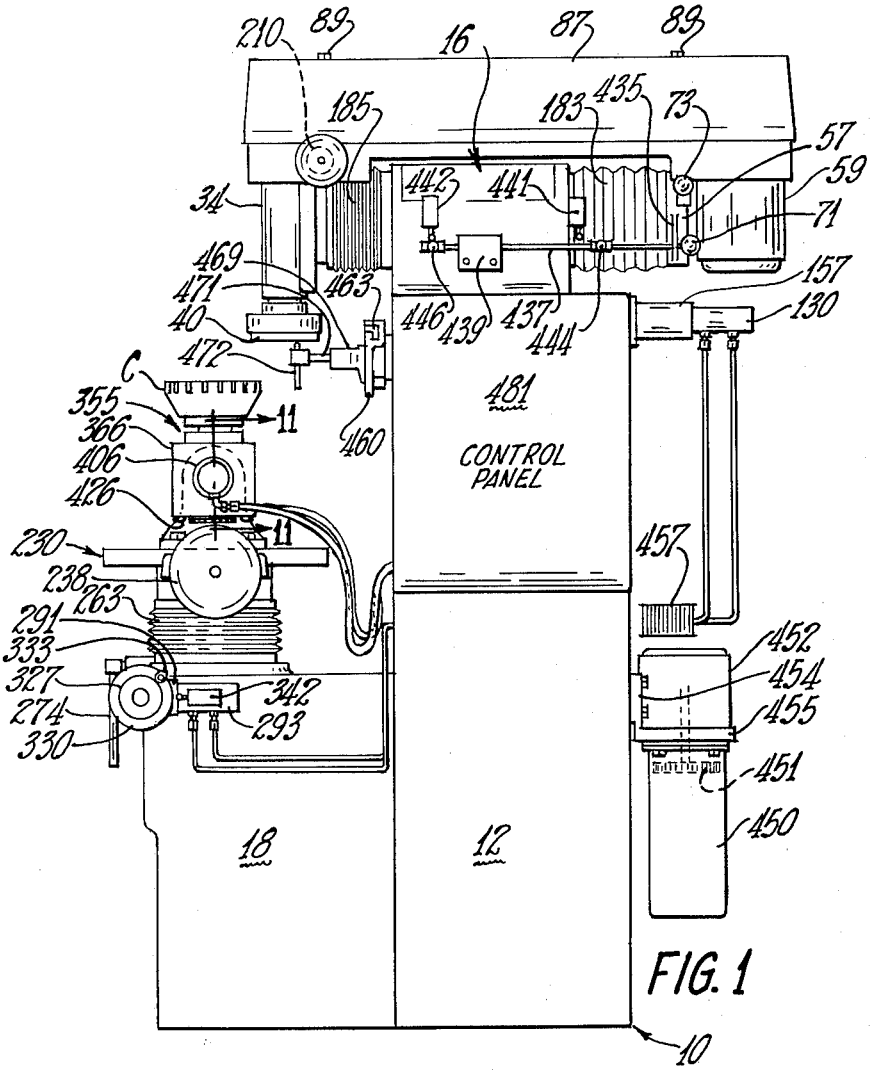
FIG. 1 is a side elevational view of a grinding machine of the invention.
Figure 2:
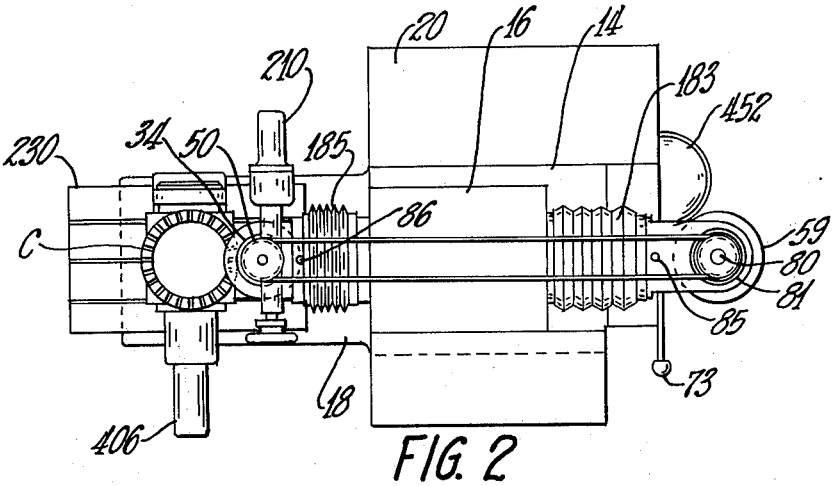
FIG. 2 is a top plan view of the grinding apparatus illustrated in FIG. 1 with the top cover removed.

Referring to the drawings in detail and initially to FIGS. 1 through 4, the grinding machine or apparatus of the invention is inclusive of a hollow frame or frame construction 10, preferably of cast iron or steel having a base portion 12, an intermediate section or portion 14 and an upper section or portion 16. The upper section 16 provides a mounting for a reciprocating ram. The frame construction 10 includes a forwardly extending pedestal portion 18 which is integral with the base portion 12. Solenoid operated valves, shown schematically in FIG. 12, for controlling flow of fluid or oil for actuating the hydraulic rotary motors are mounted by the base portion 12 and are covered by a removable closure or housing 20.

Figures 7, 8, 9:
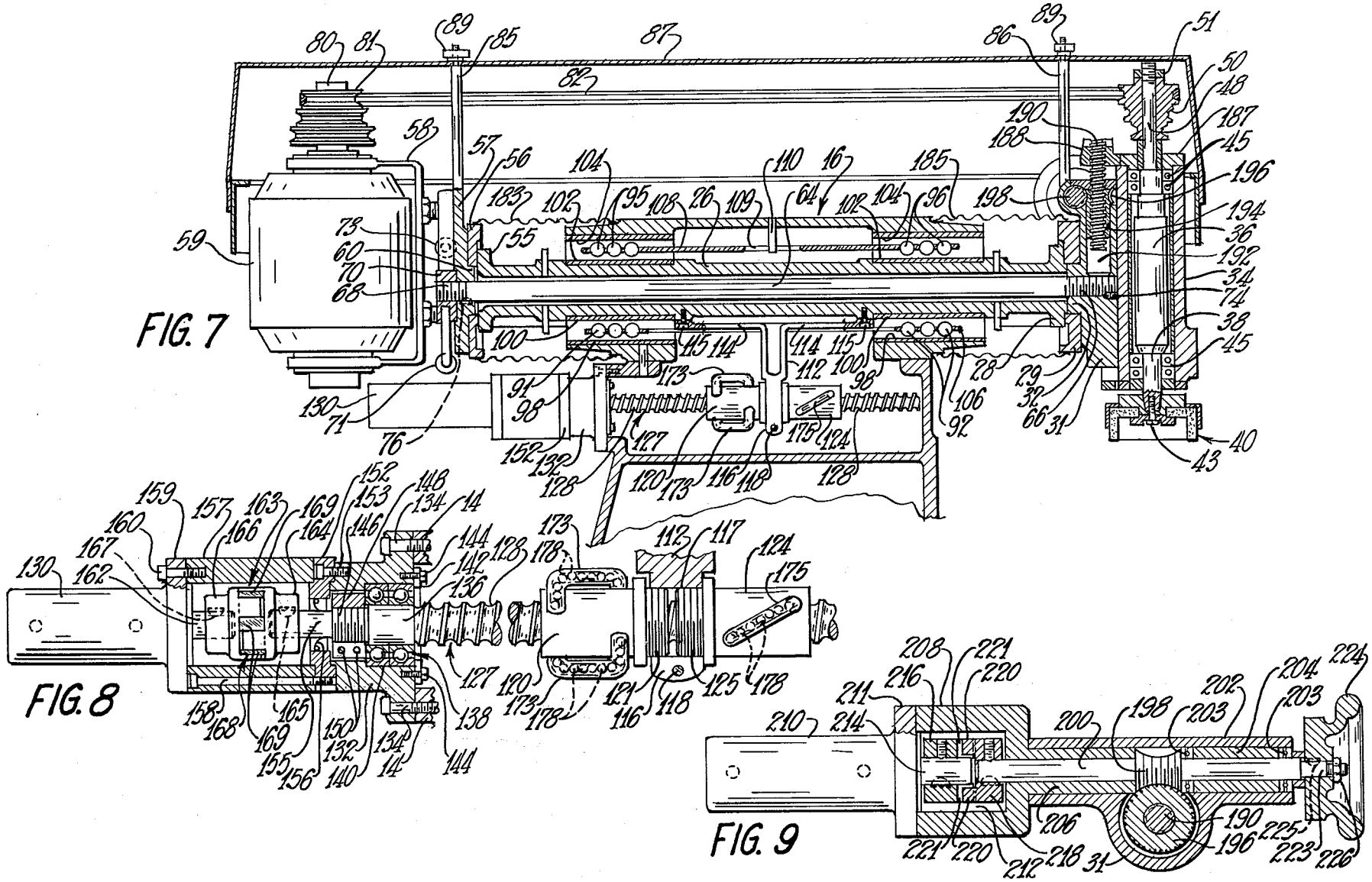
FIG. 7 is a longitudinal sectional view taken substantially on line 7—7 of FIG. 4.
FIG. 8 is an enlarged view, partly in section, of the ram reciprocating means.
FIG. 9 is a detail sectional view of the hydraulic motor driven means for feeding the grinding wheel.

Referring to FIG. 7, the extension or upwardly extending portion 16, being hollow, accommodates and supports or mounts a reciprocable ram or arbor construction, the ram construction supporting a rotatable shaft means mounting a grinding wheel and an electrically energizable motor for rotating the grinding wheel shaft. The reciprocable element or ram 26 and its supporting and guide bearing construction are similar to the ram and guide bearing construction shown in Garrison U.S. Pat. No. 2,629,972.

The ram 26 is tubular and is provided at its forward end with a flange 28 to which is secured a plate or member 29. Mounted upon the plate 29 is a member 31 having a tenon portion 32 extending into a cylindrical central bore in the plate 29 whereby the member 31 may be rotated with respect to the plate 29 and the ram or arbor 26. The member 31 is formed with guide ways (not shown) disposed normal to the axis of the ram within which is slidably mounted a cylindrically-shaped housing 34. The housing 34 is tubular and disposed within the housing is a rotatable shaft or spindle 36.

One end of the shaft 36 has a tenon portion 38 which supports a removable grinding wheel construction 40, the grinding wheel construction being securely held to the tenon 38 by means of a threaded member 43. The grinding wheel supporting shaft 36 is mounted by antifriction bearings 45 disposed in the end regions of the cylindrical member 34. The other end of the shaft 36 is fashioned with a tenon portion or tenon 48 upon which is mounted a pulley 50 securely held to the shaft by means of a nut 51 whereby the pulley rotates the grinding wheel shaft 36.

The rear end of the ram 26 is provided with a flange 55 to which is secured a circular plate 56. Mounted upon the plate 56 is a motor supporting plate or member 57 upon which is mounted a bracket 58 supporting an electrically energizable motor 59 for driving the grinding wheel shaft 36. The member 57 has a cylindrical tenon portion 60 which extends into a central opening in the plate 56. Disposed within the hollow interior of the ram 26 is a rod or shaft 64. The end of the shaft 64 adjacent the grinding wheel shaft 36 has a threaded portion 66 extending into a threaded bore in the member 31.

The rear extremity of the shaft 64 is threaded as at 68 and is adapted to receive a securing nut 70 provided with a manipulating handle 71. As shown in FIG. 7, the portion of shaft 64 adjacent the cylindrical member 34 and a portion of the member 31 have a threaded bore which receives a locking screw 74. The locking screw 74 is inserted after the threaded portion 66 of shaft 64 is threaded into the member 31 so that rotary adjustment of the shaft 64 will effect corresponding rotary movement of the cylindrical member 34 carrying the grinding wheel.

The member 57 mounting the motor supporting bracket 58 is provided with a handle 73 by which the operator may angularly adjust the shaft 64 and associated components about the axis of the shaft when the nut 70 is released. As shown in FIG. 7, the opposite end region of the shaft 64 is provided with a key 76 extending into a groove in the member 57.

When the nut 70 is "backed off", this effects a release of member 29 with the member 31 and a release of member 57 with the plate 56 so that the assembly of the shaft 64, plate 57, motor 59, members 31 and 34 and the grinding wheel mounting shaft 36 may be adjusted rotationally about the axis of the rod or shaft 64 for the purpose of changing the relative angular position of the axis of rotation of the grinding wheel and shaft 36 with respect to the axis of the shaft 64. Through this arrangement, different types of grinding wheels may be used rotatable about selected angular axis for grinding the cutting teeth of various cutters of cutting tools.

The motor shaft 80 is equipped with a pulley 81 which is connected with the pulley 50 by a power transmitting belt 82 for driving the grinding wheel mounting shaft 36. The member 57 has an upwardly extending projection 85 and the member 31 has an upwardly extending projection 86. A cover or closure member 87 enclosing the pulleys 50 and 81 and the driving belt 82 is removably mounted upon the projections 85 and 86, the closure 87 being secured by nuts 89 received on threaded tenons formed on the projections 85 and 86.

An arrangement for reciprocating the ram 26 and components carried thereby is illustrated in FIGS. 7 and 8. The ram 26 is supported and mounted for reciprocation in the manner of the ram and support means disclosed in Garrison U.S. Pat. No. 2,629,972. The ram 26 is mounted by groups of bearing balls, two groups of bearing balls 91 and 92 being disposed beneath the ram 26 and two groups of bearing balls 95 and 96 being disposed above the ram as shown in FIG. 7. The groups of bearing balls 91 and 92 are disposed between guide ways 98 of V-shaped cross section carried by the ram housing 16 and V-shaped guide means 100 carried by the ram 26.

The bearing balls 95 and 96 of the upper groups are disposed between guide ways 102 and 104 of V-shaped cross section, the guide ways 102 being carried by the ram 26 and the guide ways 104 being carried by the housing 16. The bearing balls 91 and 92 of two groups are held in proper lengthwise spaced relation by a spacing plate or cage 106, and bearing balls 95 and 96 of the other groups are held in lengthwise spaced relation by a spacing plate or cage 108. The central portion of plate 108 is fashioned with a slot 109 accommodating a pin 110 mounted by the ram housing 16, the pin serving as a guide for the plate 108 and to limit the lengthwise movement of the plate.

The arrangement for reciprocating the ram is shown in FIG. 8 and is inclusive of a rotatable shaft, rotated by a conventional hydraulically actuated rotary motor wherein bearing balls are circulated through instrumentalities or ball nuts to effect transfer of force to the ram for reciprocating the ram. A member 112 is fashioned with oppositely extending portions 114 secured to the ram 26 by screws 115.

The member 112 is fashioned with a portion 116 having a threaded bore 117. A ball nut 120 has a threaded portion 121 threaded into the bore 117. A second ball nut 124 is provided with a threaded portion 25 threaded into the bore 117 as shown in FIG. 8. The portion 116 is split or has a kerf, the portions adjacent the kerf having bores, one of which is threaded, receiving a threaded member or bolt 118.

Through this arrangement any backlash may be eliminated and this is accomplished by releasing the clamping bolt 118 and adjusting one or the other of the ball nuts 120 or 124 to a desired position relative to the member 112. The ball nuts 120 and 124 are then secured in adjusted positions by drawing up the threaded member 118 to securely clamp the portion 116 to the threaded portions 121 and 125. A rotatable shaft 127 has a spiral ball race, recess or ball screw 128 which extends through the ball nuts 120 and 124.

A hydraulically actuated rotary motor 130 of conventional construction is arranged to rotate the ball screw for reciprocating the ram, the hydraulically actuated motor 130 being controlled by means hereinafter described. As particularly shown in FIG. 8, a bearing supporting member 132 is secured to frame section 14 by screws 134. The ball screw shaft 127 is fashioned with a cylindrical portion 136 which accommodates the inner ball races of a double ball bearing construction 138.

The outer ball races of the bearing assembly are secured in a counterbore 140 in member 132 by an annular retainer 142 secured by screws 144. The shaft 127 has a threaded portion 146 accommodating a split clamp member or C-clamp 148 which may be clamped to the threaded portion 146 by drawing up screws 150 in the clamp member 148. Through this arrangement the shaft 127 is retained against endwise movement.

An annular member 152 is secured to the bearing closure 132 by screws 153, one of which is shown in FIG. 8. The member 152 provides a chamber surrounding a tenon portion 155 of the shaft 127, the chamber accommodating an annular flexible shaft seal 156. An annular member or sleeve 157 is secured to the member 152 by screws 158, one of which is shown in FIG. 8. The housing of the hydraulically-actuated motor 130 is provided with a mounting flange 159 secured to the sleeve 157 by screws 160, one of which is shown in FIG. 8.

The shaft 162 of the hydraulically-actuated rotary motor 130 extends into the sleeve 157. The tenon portion 155 of the ball screw shaft 127 and the motor shaft 162 are joined by a yieldable or resilient coupling 163. The coupling 163 comprises an annular member 164 secured on the tenon portion by a key 165. A second annular member 166 is secured on the motor shaft 162 by a key 167. Disposed between the annular members 164 and 166 is member or body 168 of yieldable nonmetallic material such as semihard rubber or the like.

The annular member 164 is fashioned with circumferentially spaced recesses accommodating projections 169 on the yieldable body 168, and the annular member 166 is fashioned with circumferentially spaced recesses accommodating projections 169 on the body 168. Through this arrangement the yieldable body 168 serves to cushion the successive reversals of rotation of the hydraulic motor 130 transmitted to the ball screw shaft 127 in reciprocating the ram 26.

The ball nut 120 is provided with ball-conveying or ball return tubes 173, and the ball nut 124 is provided with similar ball-conveying or return tubes 175, one of which is shown in FIGS. 7 and 8. The ball-conveying or return tubes 173 and 175 are filled with bearing balls 178 and the adjacent regions of the ball screw 128 are filled with bearing balls so that upon rotation of the ball screw shaft 127 by the hydraulically actuated motor 130, the spiral recess 128 of the shaft traversing the bearing balls 178 will effect longitudinal reciprocatory movement of the membere 112 member the ram 26.

As the ball screw shaft 127 rotates relative to the ball nuts 120 and 124, the bearing balls in the ball nut 120 are diverted from one end through the ball return tubes 173 to the opposiste end of the ball nut 120. Simultaneously the bearing balls in the ball nut 124 are diverted from one end through the ball return tubes 175 to the opposite end of the ball nut. Upon reversal of rotation of the hydraulically actuated motor 130 and hence reversal of rotation of the ball screw shaft 127, the bearing balls will move in reverse directions through the ball return tubes 175 and 173 to move the member 112 and the ram 26 in the opposite direction.

The continuous reciprocation of the ram moves the grinding wheel 40 into and out of abrading or grinding engagement with the teeth of the cutter or tool being ground. The ball screw and bearing ball construction is conventional, being manufactured by the Saginaw Steering Gear Division of General Motors Corporation.

As shown in FIGS. 1, 2, 3 and 7, a flexible bellows member 183 is connected with one end region of the ram housing 16 and the plate 56, and a second bellows member 185 is connected with the other end region of the ram housing 16 and the plate 29. The bellows-like members 183 and 185 are of flexible material, such as fabric or rubber, and are extensible and contractable to accommodate reciprocation of the ram. The bellows-like members provide closed chambers for the ram supporting means to prevent the ingress of dust, metal particles and other foreign material.

The apparatus is provided with hydraulically-actuated motive means for feeding the cylindrical member 34, shaft 36 and the grinding wheel downwardly at an adjustable controlled rate to effect automatic dressing of the grinding wheel. The arrangement for feeding the grinding wheel downwardly is illustrated in FIGS. 7 and 9. Disposed above the cylindrical housing 34, enclosing the grinding wheel shaft 36, is a member 187 attached to a rearwardly extending member 188 to which is secured a threaded shaft 190.

The threaded shaft 190 extends downwardly into a bore or well 192 provided in member 31. Disposed in the well 192 is a sleeve 194 having a threaded interior in threaded engagement with the shaft 190. Formed upon the sleeve is a worm wheel 196, the sleeve and worm wheel portion having a threaded bore accommodating the threaded shaft 190. The worm wheel is engaged by a worm 198 integrally formed on a shaft 200 as shown in FIG. 9. The member 31 is fashioned with a laterally extending portion 202 in which is telescoped a cylindrical sleeve or spacer 204 and a sleeve-like or tenon portion 206 formed on a housing member 208.

The shaft 200 is journally supported and antifriction thrust bearings 203 are provided adjacent the ends of the sleeve 204, the shaft 200 extending through the sleeve-like tenon 206. Mounted upon the member 208 is a hydraulically-actuated rotary motor 210 of conventional construction, the housing of the motor 210 having a flange portion 211 secured to the member 208, the hydraulically-actuated motor 210 being arranged to rotate the shaft 200, worm 198 and worm wheel 196 in order to effect vertical feeding movement of the grinding wheel shaft 36 and the grinding wheel carried thereby.

The member 208 is fashioned with an interior chamber 212 accommodating a coupling construction for establishing a drive connection between the shaft 214 of the motor 210 with the shaft 200. The coupling construction includes a collar or member 216 fixed on the motor shaft 214 and a collar or member 218 fixedly secured on the shaft 200. The member 218 has a plurality of circumferentially spaced teeth 220 extending into recesses 221 formed in the member 216 for establishing a driving connection or coupling between the members 216 and 218.

The shaft 200 has a tenon portion 223 on which is mounted a hand wheel 224, a key 225 and a nut 226 securing the hand wheel to the shaft. The hand wheel enables the manual adjustment of the vertical position of the shaft 36 and the grinding wheel 40, if desired. The activation of the hydraulically-actuated rotary motor 210 is controlled by an electrically-actuated valve means hereinafter described.

Figure 6:
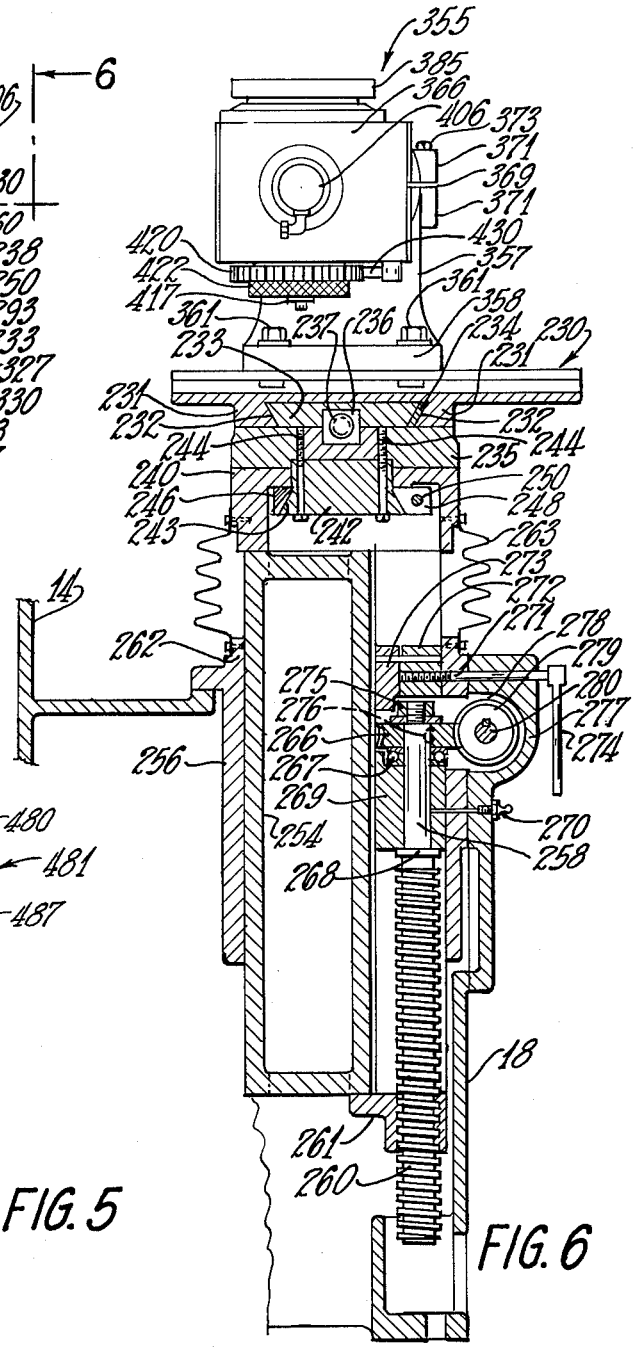
FIG. 6 is an enlarged sectional view taken substantially on the line 6—6 of FIG. 4.

The grinding machine or apparatus includes an arrangement for elevating and lowering a cutter or work-supporting apparatus or fixture, this arrangement being mounted by and within the hollow pedestal portion 18. Referring particularly to FIG. 6, the mechanism for elevating and lowering the cutter supporting fixture is inclusive of a table or platen 230 provided with depending parallel portions or ways 231. The inner opposed surfaces 232 are angularly arranged to receive a member or tang 233 of dove-tail configuration providing for lateral adjustment of the table 230.

Figure 4:
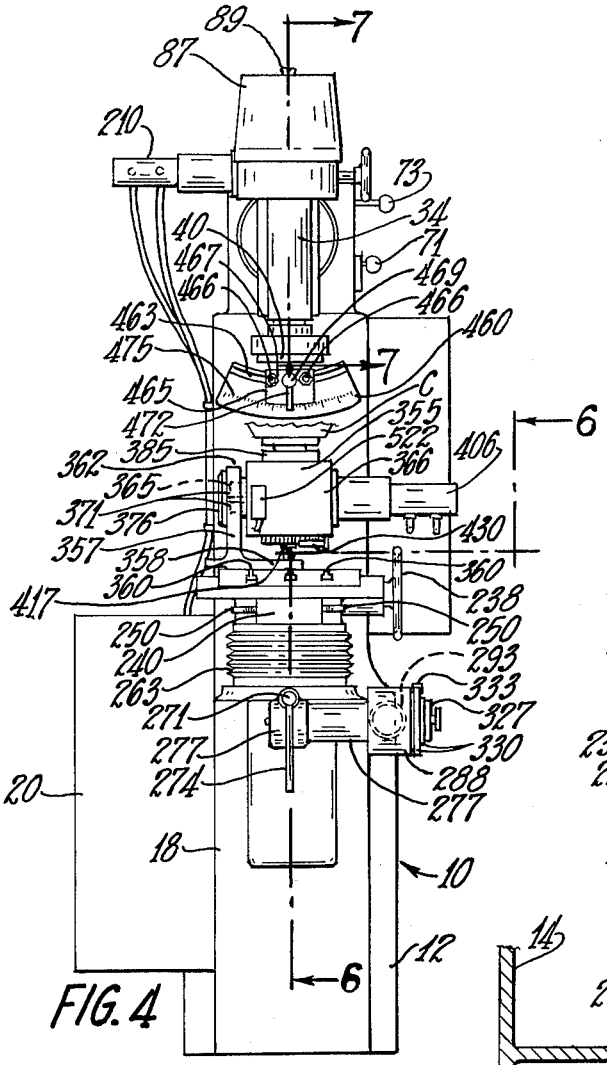
FIG. 4 is a front elevational view of the grinding machine.

A gib 234 of conventional construction is provided for eliminating lost motion between the dove-tail configuration 233 and the projections 231. The member 233 is mounted upon and secured to a member 235. The adjacent portions of members 233 and 235 at their central regions are fashioned with recesses providing a chamber in which is disposed a nut-like portion 236 depending from the dove-tail configuration 233. A threaded member 237 parallel with the surface 232 is threaded through the nut 236, and a hand wheel 238, shown in FIGS. 1 and 4, is secured to the threaded member or screw 237 for rotating the screw.

Through rotation of the screw, the table 230 may be adjusted in a direction parallel with the surfaces 232 of the ways 231. The member 235 is mounted upon a cylindrical member 240. A portion of member 235 and the interior upper portion of member 240 are bored to accommodate a cylindrically-shaped member 242, the lower portion of member 242 being formed with an outwardly flaring frusto-conically shaped portion 243. The members 235 and 242 are secured together by screws 244. The members 235 and 242 are rotatable about the central axis of the cylindrical member 242.

Surrounding the frusto-conically shaped portion 243 is a split ring or annulus 246, the portions adjacent the split or slot being enlarged forming two projections 248. The member 240 is provided with threaded openings accommodating screws 250, shown in FIG. 4, the ends of the screws respectively abutting the projections 248. Through this arrangement, the table 230 may be rotated about the central vertical axis of the member 242 by releasing one of the screws 250 and drawing up the other screw 250 whereby the screws engaging the projections 248 lock the table in the desired position of rotation.

Disposed beneath and secured to the member 240 is a ram or post 254 which is of rectangular cross section and is guided for vertical movement by guide means or ways 256, one of which is shown in FIG. 6. Arranged on a vertical axis parallel with the vertically disposed ram 254 is a shaft 258 having a threaded portion or screw 260. Secured to the lower end of the ram or post 254 is a member 261 having a threaded opening whereby projection 261 receives and accommodates the screw or threaded portion 260 of the shaft 258.

The upper portion 262 of member 256 is circular and receives one end of a flexible bellows 263, the other end of the bellows being secured to member 240 as shown in FIG. 6. Through this arrangement foreign matter, such as metal and abrasive particles, is prevented from entry into the table operating mechanism.

Mounted upon the upper end of shaft 258 is a worm wheel 266, an antifriction bearing 267 being disposed beneath the worm wheel. The shaft 258 is fashioned with a flange 268, and disposed between the bearing 267 and flange 268 is a member 269, the shaft being lubricated by a lubricant fitting 270 threaded into the member 277. A member 271 is threaded into a member 272 which engages a locking block 273 for locking the ram 254 in an adjusted position if desired. A manipulating handle 274 is mounted on the member 271 for manipulating the member.

The upper end of shaft 258 has a threaded tenon accommodating a nut 275 for securing the worm wheel on the shaft 258. A key 276 mounted by the shaft 258 engages in a groove in the worm wheel 266 whereby the worm wheel rotates with the shaft 258. The pedestal portion or pedestal 18 is fashioned with a portion 277 having a chamber 278 accommodating a worm 279 mounted on a shaft 280, the shaft 280 being journaled in bores 281 in the pedestal portion 277, one of the bores being shown in FIG. 10.

Figure 10:
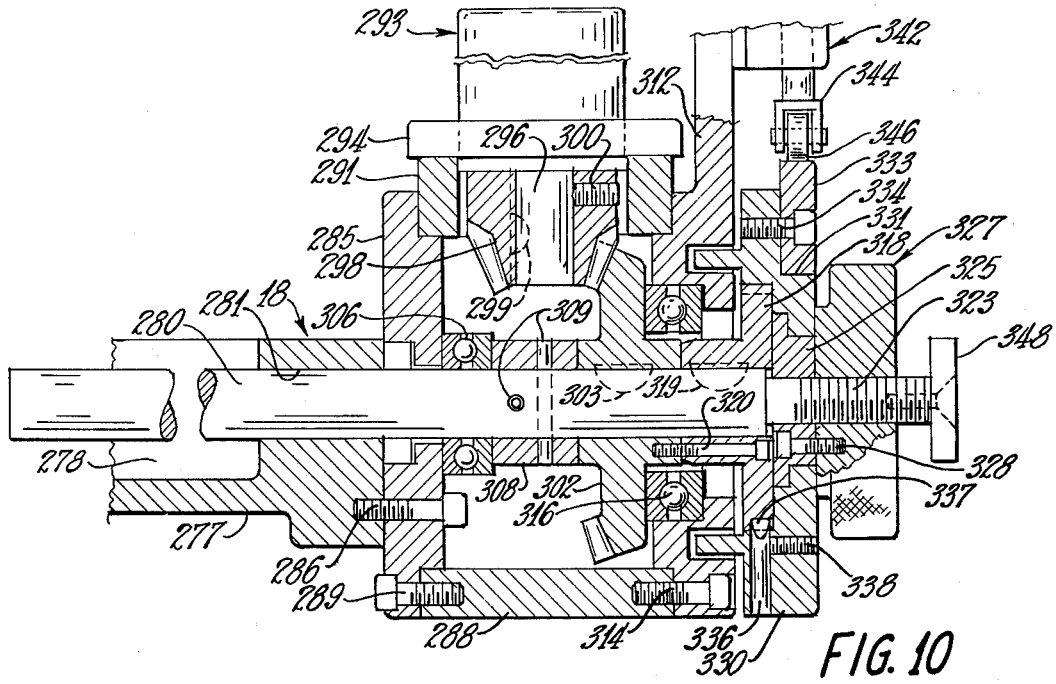
FIG. 10 is an enlarged detail sectional view illustrating the motor driven arrangement for raising and lowering the work supporting table.

The arrangement for rotating the shaft 280 for elevating and lowering the work supporting table 230 is illustrated in FIG. 10. Mounted on portion 277 of the pedestal 18 is a circular plate or member 285 secured to portion 277 by screws 286, one of which is shown in FIG. 10. A housing 288 of generally cylindrical shape is secured to the plate 285 by screws 289 one of which is shown in FIG. 10. The housing 288 is formed with an integral annular boss portion 291.

Mounted upon the boss portion 291 is a hydraulically-actuated rotary motor 293 of conventional construction, the housing of the motor 293 having a flange 294 secured to the boss portion 291 by means (not shown). The shaft 296 of the motor 293 is equipped with a bevel pinion 298 secured to the shaft by a key 299 and a setscrew 300. Mounted on the shaft 280 is a bevel gear 302 fixed on the shaft by a key 303.

The teeth of the pinion 298 are enmeshed with the teeth of the bevel gear 302 whereby the bevel gear and the shaft 280 are rotated by the hydraulically-actuated motor 293. Mounted on the shaft 280 and abutting the inner surface of plate 285 is an antifriction or ball bearing construction 306. Mounted on the shaft 280 between the hub portion of the bevel gear 302 and the antifriction bearing construction 306 is an annular member or spacing collar 308 secured to the shaft by pins 309.

Mounted on the opposite end of the housing 288 is a plate or member 312, secured to the housing 288 by screws 314, one of which is shown in FIG. 10. Supported in an annular recess in the member 312 is an antifriction or ball bearing construction 316 which functions as a thrust bearing for the bevel gear 302. Mounted upon the shaft 280 is a member 318 secured by a key 319 so that the member 318 rotates with the shaft 280. The member 318 is secured to the bevel gear 302 by a threaded member 320.

Mounted upon an unthreaded portion of a tenon 323 formed on an end region of the shaft 280 is a member 325 which is rotatable relative to the tenon 323. Threaded onto a threaded portion of the tenon portion 323 is a manipulating knob 327 secured to member 325 by a screw 328. Supported on the member 325 for rotation relative thereto is a circular disc 330 having a recess 331 in which is fitted a radially-projecting limit switch actuator 333, shown in FIGS. 1, 4 and 10, which is secured to member 330 by a screw 334.

The circular disc 330 is provided with a radially disposed pin 336 having a beveled end 337 which extends into a selected one of a series of 50 peripheral notches in the member 318, the pin 336 being locked into the member 330 by a setscrew 338. A portion of the periphery of the circular disc 330 is provided with 50 circumferentially-spaced graduations corresponding with the 50 peripheral notches, each graduation indicating an elevation movement of one thousandth of an inch of the table 230 by the elevating mechanism shown in FIGS. 6 and 10.

Mounted upon an extending portion of plate 312 is a limit switch 342 for interrupting operations when the grinding operations on a cutter are completed. As shown in FIG. 10, the limit switch mechanism 342 includes a reciprocable clevis member 344 upon which is rotatably supported a roller or follower 346 which is actuated by the actuator 333 when the disc 330 is rotated by the hydraulically-actuated rotary motor 293 to engage the actuator 333 with the roller 346 to thereby actuate the limit switch.

Under certain conditions of operation, it may be desirable to adjust the disc 330 axially of the shaft 380 to move the limit switch actuator or cam 333 out of the path of the limit switch actuating roller 346. By rotating the manipulating knob 327 on the threaded portion of the tenon 323, the disc 330 is moved in a a right-hand direction, as viewed in FIG. 10, to a position lengthwise of the shaft 280 so that the work 333 does not engage the roller 346.

A stop member 348 is secured to the end of the tenon 323 of shaft 280 to limit the movement of the manipulating member or knob 327 lengthwise of the shaft 280. When oil or other fluid actuates the hydraulic motor 293, the pinion 298 rotates the gear 302 and the shaft 280, the worm 279 mounted on the shaft 280 rotates the worm wheel 266 and the screw or threaded member 260 to elevate or lower the work supporting table 230.

The grinding apparatus or machine includes a cutter supporting fixture and mechanism 355 adapted to be mounted on the table 230 and to support cutters of various kinds and types in any position whereby the teeth of a cutter may be ground by the grinding wheel and the cutter indexed automatically to move successive cutting teeth into the path of the grinding wheel by hydraulically-actuated motive means. The fixture or apparatus 355 for supporting a cutting tool or cutter to be ground is illustrated in FIGS. 1, 2, 3, 4, 6 and 11. A bracket or base member 357 is fashioned with a planar portion 358.

As shown in FIGS. 4 and 6, the table 230 is fashioned with T-shaped slots 360 which accomodate bolts 361 for securing the bracket 357 to the table 230. Through this arrangement the bracket 357 may be adjusted relative to the table 230. The upwardly extending portion 362 of the bracket 357 is of hollow configuration defined by a cylindrical surface 363 shown in FIG. 11. The surface 363 rotatably receives a trunion 365 of a member or housing 366.

A semicylindrical configuration 362 of the upper region of the bracket 357 is slit as at 369, shown in FIG. 6, which kerf or slit separates bosses 371 formed on the portion 362. A threaded member or screw 373 is threaded into a threaded bore in one of the bosses 371 whereby the screw 373 may be drawn up to clamp the trunnion 365 of member 366 in an adjusted position. Secured to the end region of the trunnion 365 is a dial 376 bearing graduations. Through this means the cutter mounting fixture 355 may be angularly adjusted for grinding teeth of cutters of various shapes.

Figure 11:
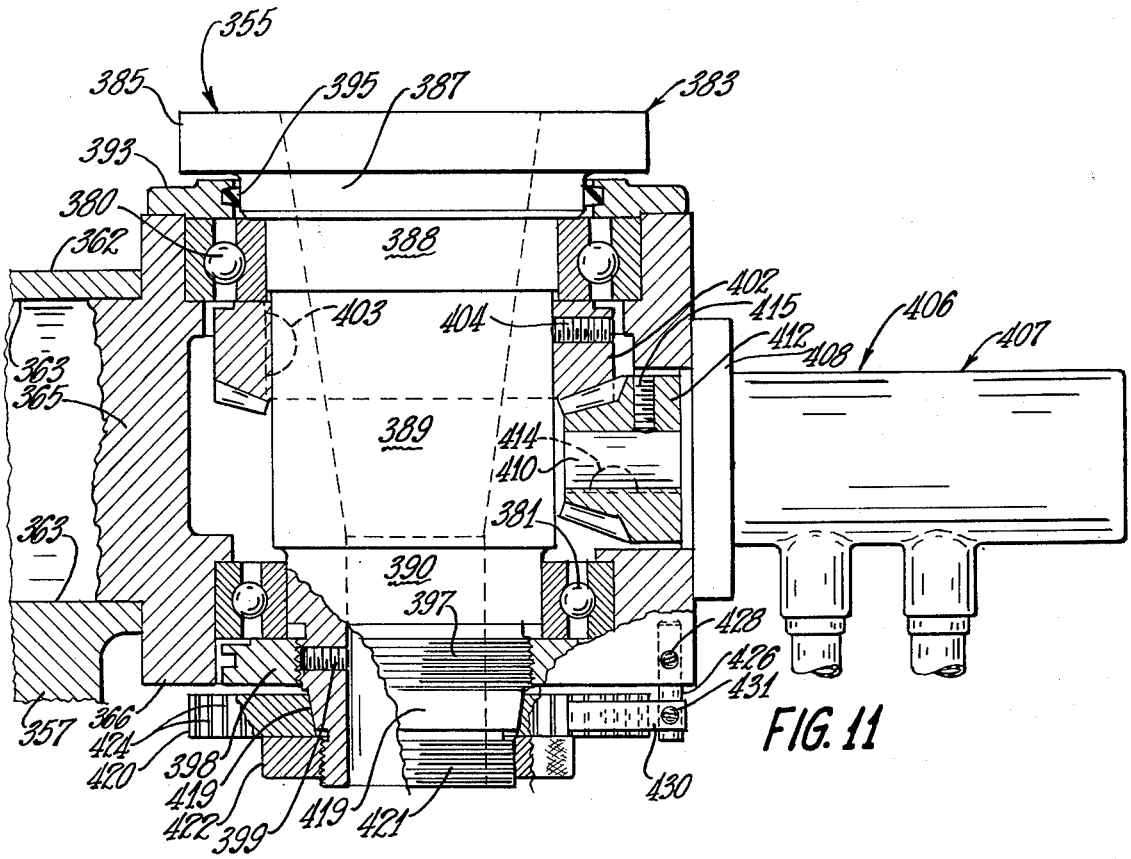
FIG. 11 is an enlarged sectional view taken substantially on line 11—11 of FIG. 1.

The housing 366 is of substantially cubicle configuration and encloses components of a drive means and mechanism for indexing a cutter or cutting tool for sequentially grinding successive teeth of the cutter or cutting tool. Referring particularly to FIG. 11, the wall of the housing 366 is fashioned with two cylindrical recesses which respectively accommodate ball bearing or antifriction bearing means 380 and 381. A cutter or cutting tool mounting means 383 is rotatably supported by the bearings 380 and 381.

The mounting means 383 includes a planar portion or cutter support 385 having a first cylindrical portion 387, a second cylindrical portion 388, a third cylindrical portion 389 and a fourth cylindrical portion 390. A cover plate 393 is secured to the housing adjacent the bearing means 380. The region of the cover plate 393 adjacent the cylindrical portion 387 of the member 383 is fashioned with a recess accommodating a sealing member 395 engaging the portion 387 to exclude abrasive particles or other foreign matter from the interior of the housing 366.

The cylindrical portion 388 of member 383 is snugly fitted into the inner race of the bearing means 380 and the cylindrical portion 390 is fitted into the inner race of the other bearing means 381. The member 383 has a threaded portion 397 receiving an annulus or ring 398 which may be adjusted to eliminate end play of the member 383. A setscrew 399 carried by member 383 is drawn up to hold the ring 398 in adjusted position.

Snugly mounted on the cylindrical portion 389 of member 383 is a bevel gear 402, a key 403 and a setscrew 404 securing the gear 402 on the cylindrical portion 389 so that rotation of the gear 402 rotates the member 383. A hydraulically-actuated rotary motor 406 of conventional construction is provided for rotating the gear 402. The housing 407 of the hydraulic motor 406 has a flange 408 secured to the housing 366 by screws (not shown). The shaft 410 of the motor 406 extends into the housing, a pinion 412 being mounted on the motor shaft.

Figure 3:
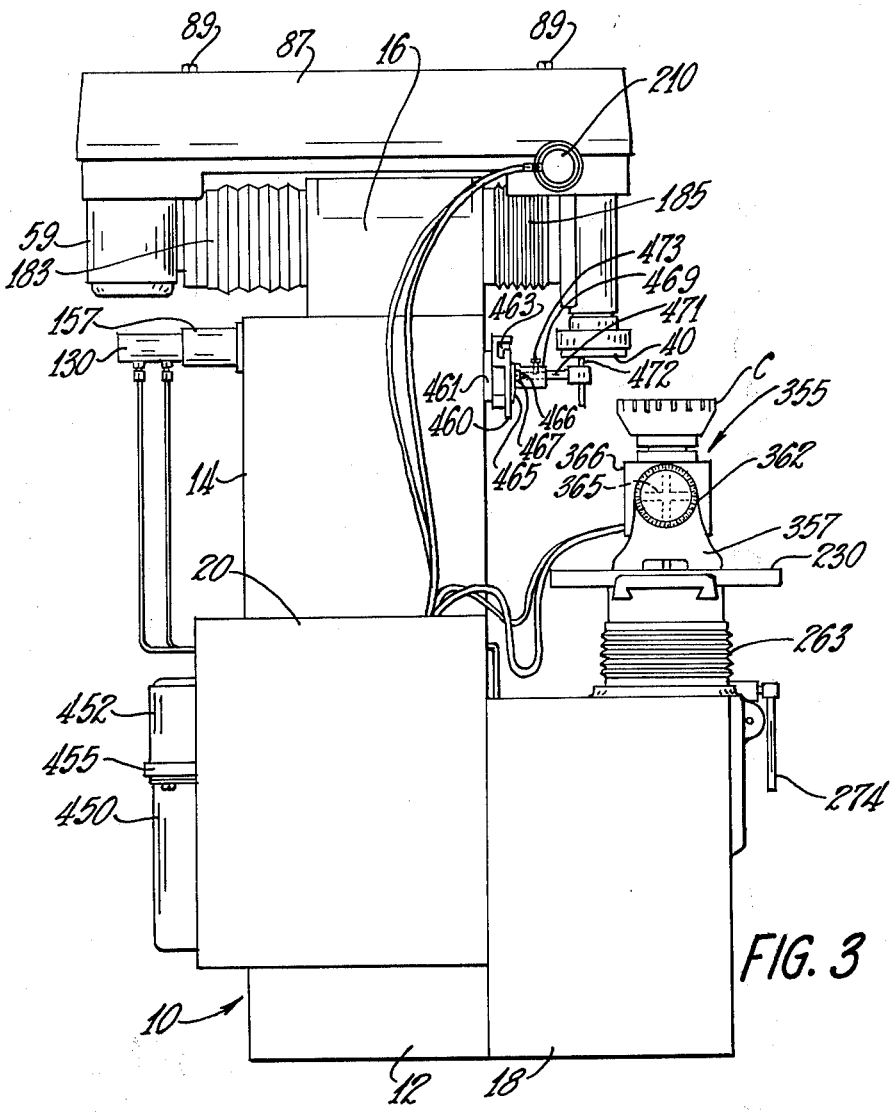
FIG. 3 is an elevational view of the opposite side of the grinding machine.

The pinion 412 is secured on the shaft by a key 414 and a setscrew 415. The teeth of the pinion are enmeshed with the teeth of the bevel gear 402 whereby rotation of the motor shaft 410 effects rotation of the cutter support or member 385. The toothed cutter or cutting tool "C" to be ground, shown in FIGS. 1, 3 and 4, is mounted upon the cutter support 385 and is secured to the support by a shaft or mandrel (not shown) extending through the central region of the support 385 and secured by a draw bar 417, shown in FIGS. 4 and 6, engaged with a threaded portion of the cutter retaining shaft or mandrel.

The hydraulically-actuated motor 406 is intermittently actuated to move the cutter being ground to bring successive teeth of the cutter into grinding position. Means is provided for holding the cutter in an indexed position while a tooth of the cutter is being ground. As various types of cutters have different numbers of cutting teeth, a toothed member having the same number of teeth as the number of teeth in the cutter to be ground is provided and is removable whereby the proper toothed members may be employed for grinding various cutters.

Referring to FIG. 11, the member 385 is provided with frusto-conically shaped exterior portion 419 which receives an indexing member or disc 420 which is secured by a removable nut 422 received on a threaded portion 421 of the cutter mounting means 385. The indexing member or disc 420 has circumferentially-spaced raised ridges or lands 424 corresponding in number and spacing to the teeth in the cutter being ground.

Flexible means is provided for successive engagement with the ridges 424 to temporarily retain the cutter in grinding position during the grinding of a cutter tooth of a cutter having right-hand teeth and a second indexing means is provided for engagement with the ridges of a disc 420 for retaining a cutter having left-hand teeth. As shown in FIG. 11, one corner region of the housing 366 is provided with a bore receiving a cylindrically-shaped member 426 which is slidable and rotatable and is held in adjusted position by a setscrew 428.

The portion of the member 426 exteriorly of the bore supports an indexing member comprising a comparatively thin plate spring 430, one end of which is secured to member 426 by a screw 431. The distal end of the plate spring 430 is adapted for engagement with the ridges or lands 424 on the disc 420. By releasing the setscrew 438, the cylindrical member 426 may be rotated to engage or disengage the plate spring 430 with the ridges or lands on the disc 420.

The second indexing means is provided in an adjacent corner region of the housing 366, the second means including an adjustable cylindrical member 426′, shown in FIG. 1, which is equipped with a plate spring identical with the plate spring 430 which is adapted for engagement with ridges of a disc 420 for grinding the teeth of a cutter having left-handed teeth. When a right-hand toothed cutter is to be ground, the member 426 is adjusted so that the distal end of the indexing plate or strip 430 engages the lands or ridges 424 on the disc 420.

When a cutter having left-hand teeth is to be ground, the member 426 is adjusted to move the spring plate 430 out of the path of the ridges or lands on the disc 420, and the cylindrical member 426′, shown in FIG. 1, is adjusted so that the spring plate carried thereby engages the lands or ridges 424. The hydraulic motor 406 is actuated, as hereinafter described, after each cycle of engagement of the grinding wheel with a cutter tooth so as to move the cutter to bring the next succeeding cutter tooth into a position to be engaged by the grinding wheel at the next reciprocation of the ram 26.

Referring to FIG. 1, the plate 57 at the rear end of the ram 26 is provided with a laterally extending portion or projection 435. A rod or shaft 437 has one end secured to the projection 435, the rod 437 extending parallel with the path of travel of the ram, the rod 437 extending through a rod guiding member 439 secured to the ram housing 16. Mounted by the ram housing 16 is a limit switch 441 and a second limit switch 442. Mounted upon the rod 437 is a limit switch actuator 444 for actuating the limit switch 441.

Also mounted upon the rod 437 is a limit switch actuator 446 for actuating the second limit switch 442. The limit switches 441 and 442 actuate the valve means for controlling the flow and direction of flow of fluid to the hydraulically-actuated motor 130. With reference to FIG. 1, the actuator 446 actuates the limit switch 442 to operate valve mechanism to direct fluid flow to the motor 130 to advance the ram 26 in a left-hand direction to effect a grinding stroke of the grinding wheel on a cutter tooth.

Simultaneously the rod 437 is moved in a left-hand direction and when the actuator 444 engages the limit switch 441, a valve means is actuated to reverse the flow of fluid to the motor 130 and thereby move the ram 26 and the grinding wheel in a right-hand direction until the actuator 446 engages the limit switch 442.

The hydraulically-actuated rotary motors are actuated by oil under pressure. Positioned at the rear of the base frame 12 is a tank or reservoir 450. Mounted above the reservoir 450 is an electrically driven motor 452 which drives a hydraulic pump 451 contained within the reservoir 450. The housing of the motor 452 is provided with a mounting bracket 454 for securing the motor to the rear surface of the base frame 12. The tank or reservoir 450 is secured to a flange 455 provided on the housing of the motor 452.

The energization of the motor 452 rotates the fluid pump which is supplied with oil in the reservoir and develops oil pressure for actuating the hydraulically-actuated rotary motors. Disposed above the motor 452 and supported by means (not shown) is an oil cooler 457 of conventional construction for cooling the oil. The oil cooling means 457 comprises oil circulating tubes provided with cooling fins.

The grinding machine is equipped with means for dressing the grinding wheel. Referring particularly to FIGS. 1, 3 and 4, there is mounted upon the front face or surface of the frame portion 14 a member 460 having a mounting portion 461 secured to the front surface of the frame portion 14. As shown in FIG. 4, the member 460 is of sector shape having an arcuate or curved slot 463 of T-shaped cross section. The curvature of the slot 463 is generated about the axis of the ram 26.

The member 460 supports a fitting 465 which is adjustable along the curved path provided by the curved slot 463. The fitting 465 is provided with openings receiving bolts 466 having heads fitting in the T-shaped slot 463. The bolts 466 are equipped with nuts 467 which, when drawn up, secure the fitting 465 to the mounting plate 460 in an adjusted position. The fitting 465 has a forwardly projecting portion 469 having a bore which receives a member 471, the member 471 supporting a wheel dressing tool 472.

The projecting portion 469 is slit as shown in FIG. 3 and is provided with a bore receiving a bolt 473 which, when drawn up, secures the member 471 in an adjusted position to support the wheel dressing tool or diamond in cooperative relation with the grinding wheel 40. When the grinding wheel shaft 36 and the grinding wheel are moved to an angular position away from a vertical position to adapt the grinding wheel to grind the teeth of a particular cutter or cutting tool, the member 469 may be adjusted along the arcuate slot 463 in the member 460 to establish a cooperative relation between the wheel dressing member 472 and the grinding wheel.

The mounting plate or member 460 is provided with graduations 475 to facilitate accurate adjustment of the wheel dressing tool 472 in relation to the angular position of the grinding wheel.

Figure 12:
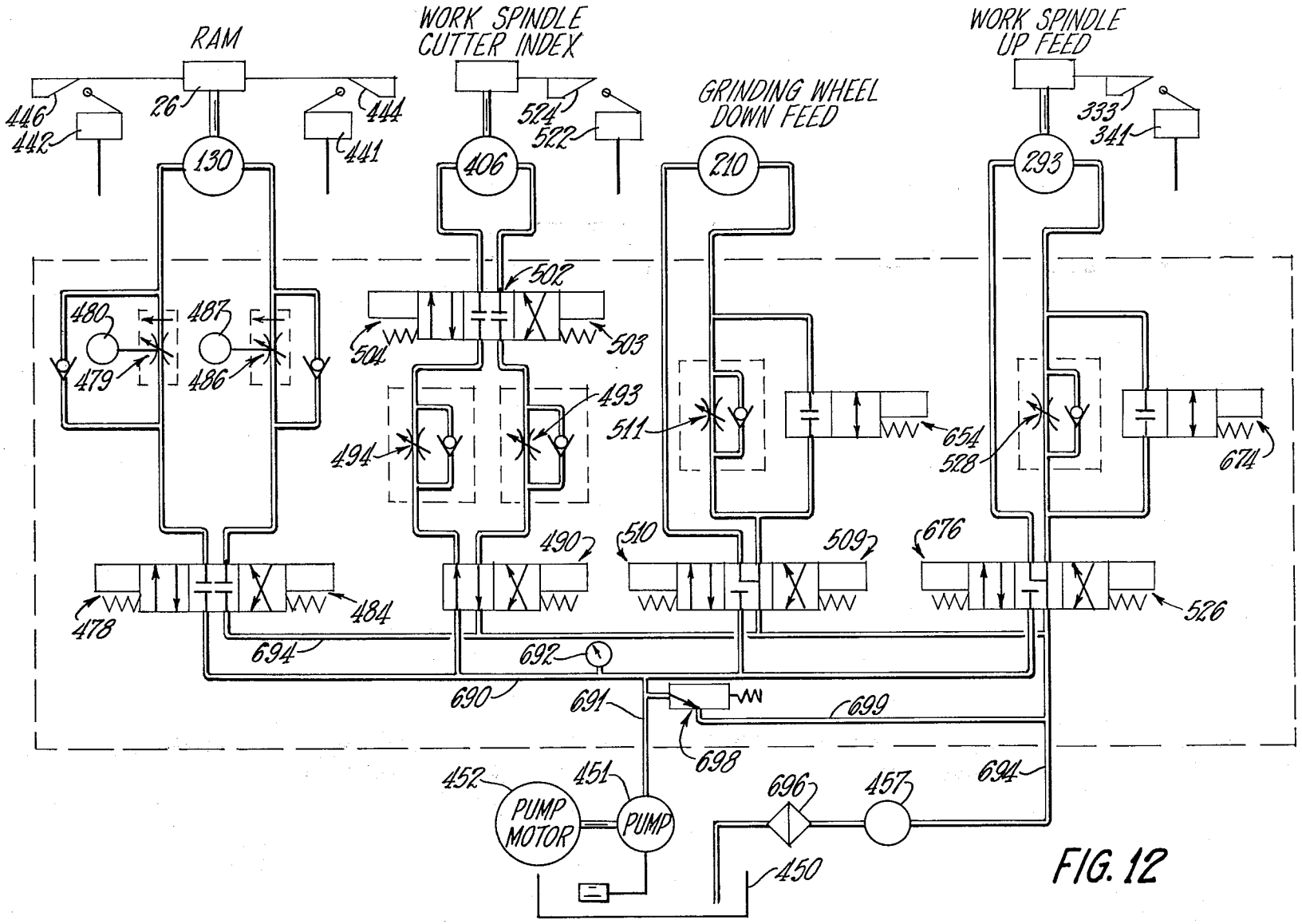
FIG. 12 is a schematic drawing of the hydraulic system for actuating various mechanisms or instrumentalities of the grinding apparatus.

FIG. 12 illustrates schematically the components of the hydraulic system for actuating and controlling the hydraulically actuated rotary motor 130 for reciprocating the ram 26, rotary hydraulic motor 210 for feeding the grinding wheel downwardly or upwardly, rotary hydraulic motor 293 for elevating and lowering the cutter supporting table 230, and the rotary hydraulic motor 406 for indexing the cutter to present successive teeth of the cutter to be engaged by the grinding wheel.

Actuation of the limit switch 442 by the actuator 446 energizes the solenoid operated valve 478 to admit fluid, such as oil, to the rotary motor 130 to rotate the motor in a direction to move the ram 26 forwardly in a left-hand direction as viewed in FIG. 1. The forward speed of the ram 26 is controlled by a valve 479 adjusted by a control member 480 on the control panel 481 in FIG. 5.

When the ram reaches its forwardmost position, the actuator 444 actuates limit switch 441 which energizes solenoid operated valve 484 to direct oil in a reverse direction to the hydraulic motor 130, the reversing movement of the motor retracting the ram to the position shown in FIG. 1.

Figure 5:
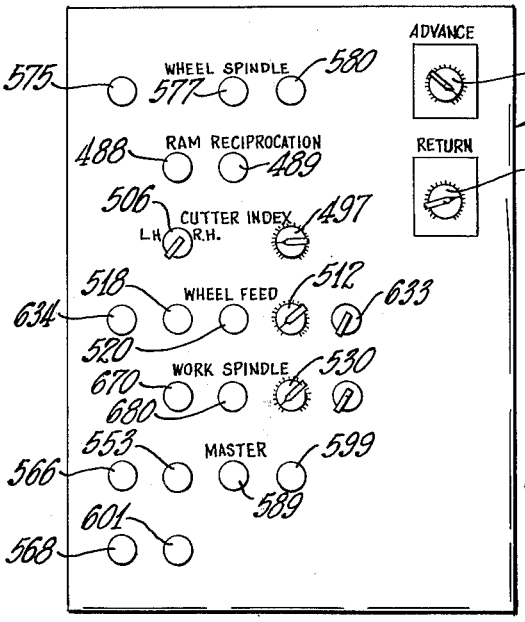
FIG. 5 is an elevational view of a panel mounting controls for components or instrumentalities of the grinding machine.

The rate of travel of the ram 26 toward retracted position is controlled by a valve 486 which may be adjusted by a control member 487, shown in FIG. 5, on the control panel 481. Control buttons or members 488 and 489 on the panel 481, shown in FIG. 5, may be manipulated by the operator to effect control of the valves 478 and 484 for advancing or retracting the ram independently of the automatic reciprocation of the ram.

The limit switch 442 is connected with a solenoid operated valve 490 and, upon each actuation of the limit switch 442, the valve 490 is opened by causing the hydraulic motor 406 to rotate in one direction momentarily and return which indexes the cutter C to the next tooth. The indexing and return speeds are controlled respectively by adjustable valves 493 and 494.

Figure 14:
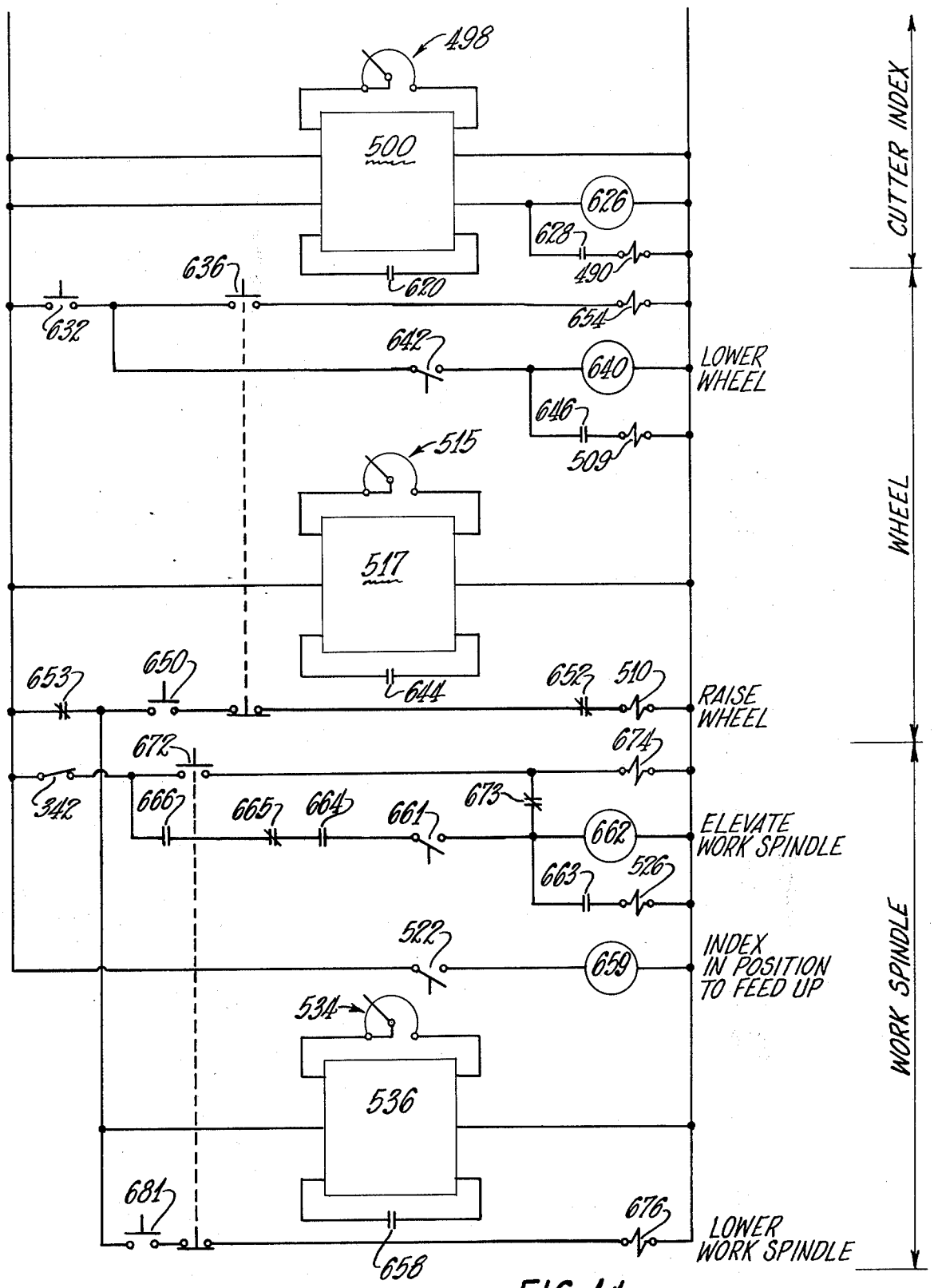

The amount of index, that is, the duration of opening of the indexing valve 490 is controlled by a control member 497 on the panel shown in FIG. 5 which operates a potentiometer 498 mounted by a conventional solid state timing relay 500, the latter being shown schematically on the circuit diagram, FIG. 14. A dual valve construction 502 having a solenoid-operated valve 503 and a second solenoid operated valve 504 effects operation of the indexing motor 406 in both directions.

Energization of the solenoid operated valve 503 indexes the cutter in one direction, and energization of the solenoid operated valve 504 actuates the motor 406 in the opposite direction so as to accommodate the apparatus to indexing of a cutter having right-hand teeth or a cutter having left-hand teeth. The direction of rotation of indexing a cutter by the dual valve unit 502 is controlled by a rotatable control member 506 shown in FIG. 5.

The control member 506 in the position shown in FIG. 5 effects energization of the solenoid operated valve 503 for indexing teeth of a right-hand cutter. When the control member 506 is rotated counterclockwise to a left-hand position, then the solenoid controlled valve 504 effects rotation of a cutter having left-hand cutting teeth in the opposite direction.

Each actuation of the limit switch 442 energizes the solenoid of a solenoid operated valve 509 to effect flow of oil to the hydraulic motor 210, the motor rotating in a direction to momentarily cause a small down feed movement of the wheel spindle 36 and the grinding wheel 40 so that during the succeeding movement of the ram 26, the grinding wheel is engaged with the dressing tool 472 to dress the wheel preparatory to engagement of the grinding wheel with the next succeeding tooth of the cutter being ground.

The flow of oil to the motor 210 for down feeding the grinding wheel is controlled by an adjustable valve 511. The control valve 511 is adjusted by manipulating the member 512 on the panel 481. The member 512 adjusts the potentiometer 515 associated with a solid state timer relay 517 shown in FIG. 14. By manipulating the potentiometer control member 512, the operator is enabled to minutely adjust the amount of down feed of the grinding wheel to effect a dressing stroke of the wheel with the wheel dressing diamond or tool 472.

By manipulating the control members 518 and 520 on the control panel 481 the operator may selectively energize the solenoid valves 509 and 510 for actuating the motor 210 in either direction to raise or lower the grinding wheel 40.

At each revolution of the cutter or work supporting spindle 385, an actuator 524, shown schematically in FIG. 12, engages a limit switch 522 mounted on the housing 366 as shown in FIG. 4. The limit switch 522 when actuated by the member 524 energizes a solenoid actuated valve 526 shown schematically in FIG. 12. Actuation of the valve 526 opens the valve momentarily admitting liquid to the rotary hydraulic motor 293 to rotate the table elevating screw 260 elevating the table 230 and cutter C slightly upwardly preparatory to again grinding the cutter teeth in the next cycle of operations.

The flow of oil to the hydraulic motor 293 for elevating the work supporting table or apparatus is regulated by an adjustable valve 528. Adjustment of the valve 528 is attained by a rotatable member 530 on the panel 481, the member 530 being connected with a potentiometer 534, shown schematically in FIG. 14, the potentiometer 534 being associated with a conventional solid state timing relay 536.

During upward movement of the cutter supporting means by the screw spindle 260, the disc or member 330, shown in FIGS. 1 and 4, rotates until the cam or abutment 333 engages the limit switch 342, shown in FIGS. 1, 10 and 12, to interrupt the elevating movement or upfeeding of the screw 260, the work table 230 and the cutter C mounted on the cutter support 385 at the completion of the final grinding of the teeth of the cutter.

Figure 13:
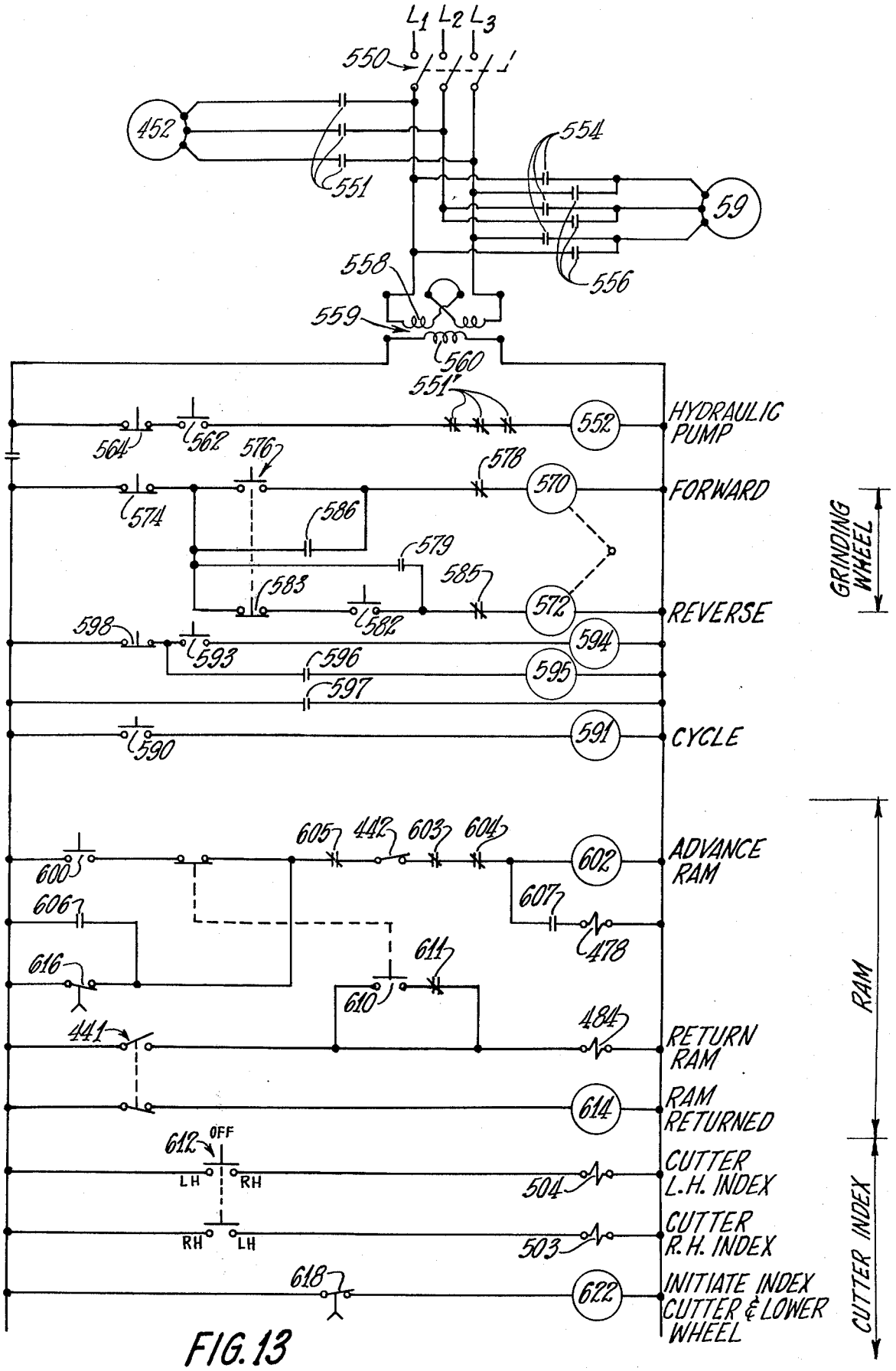
FIGS. 13 and 14 are schematic diagrams of the circuits and electrically actuated and controlled components of the grinding apparatus.

Schematic circuit diagrams of the controls and activating means for the instrumentalities, viz. the hydraulic rotary motors, are illustrated in FIGS. 13 and 14. The electric current supply may be a 450 volt, three phase system indicated at L1, L2 and L3 connected with a control switch 550. The three phase current is fed to the electric motor 452 which drives the hydraulic pump or oil pump 451 through relay contacts 551.

The electric motor 59 for rotating the spindle 36 and the grinding wheel 40 is connected to the three phase current through contacts of a relay. The contacts 554 are arranged to supply current to the motor 59 for rotating the grinding wheel in one direction, and the contacts 556 effect rotation of the grinding wheel motor 59 in the opposite direction.

The current supply lines L1 and L3 are connected with the primary 558 of a transformer 559, the transformer 559 reducing the voltage in the secondary winding 560 of the transformer to a voltage of about 115 volts. The secondary 560 of the transformer supplies current to the control components for the instrumentalities of the grinding apparatus. The relay 552 has contacts 551' which are associated with relay contacts 551 for controlling the operation of the pump motor 452.

The circuit is provided with a master starting switch 562 and a master stop switch 564. The master starting switch is operated by a control member 566 on the control panel 481, and the master stop switch 564 is operated by a button or control member 568 on the panel 481.

The electric motor 59 for rotating the grinding wheel is of a reversible type so that the grinding wheel may be rotated in either direction. In the circuit diagram, FIG. 13, direction control relays 570 and 572 are provided for rotating the spindle 36 and grinding wheel 40 in a clockwise direction or counterclockwise direction depending upon whether a right-hand cutter or a left-hand cutter is being processed. The circuit for the grinding wheel motor 59 for rotating the grinding wheel in a clockwise direction includes a manual switch 574 for conditioning the grinding wheel motor circuit for operation.

The switch 574 is actuated by the control member 575 on the control panel 481. When the grinding wheel is to be rotated in a clockwise direction, the operator closes the switch 576 by manipulating the member 577 on the control panel 481. The grinding wheel motor 59 is rotated in a clockwise direction through the relay contacts 578 and 579. When the grinding wheel motor 59 is to be rotated in a counterclockwise direction, the operator closes the switch 582 which action opens the switch 576 and closes the switch 583. The direction of rotation of the motor 59 is thus reversed through the relay contacts 585 and 586.

To provide automatic operation of the successive processing steps in grinding the teeth of a cutter, the operator depresses the member or button 589 on the control panel 481 closing switch 593. The automatic cycle is initiated by closing the cycle starting switch 590 by depressing the member 601 energizing relay 591. Closing the automatic operation switch 593 effects automatic operation through relay 594, relay 595, relay contacts 596 and 597 shown in FIG. 13.

Assuming that the limit switch 442, shown in FIGS. 1 and 12, is in closed position, the ram 26 will be advanced in a left-hand direction, as viewed in FIG. 1, to perform a grinding stroke of the wheel 40 on a tooth of the cutter C. The closing of the limit switch 442 also activates contacts 605 and 606 and the relay contact 603 which lowers the grinding wheel as hereinafter described, and through relay contact 604 elevates the work support 385 by slight rotation of the screw 260 by the hydraulic motor 293 as hereinafter described.

A contact 607 of the relay 602 energizes the solenoid operated valve 478 to rotate the motor 130 in a direction to advance the ram 26 in a left-hand direction, as viewed in FIG. 1, toward the cutter C. As the ram 26 approaches its forwardmost position, the abutment 444 actuates the limit switch 441 which completes the circuit through the solenoid operated valve 484 to direct flow of oil under pressure to the motor 130 to return the ram in a right-hand direction, as viewed in FIG. 1, moving the grinding wheel away from the cutter C.

The cutter indexing means is operable for indexing a right-hand cutter or indexing a left-hand cutter. If a right-hand cutter is to be ground or processed, the operator moves the control member 506 on the control panel 481 to the right-hand position, the control member 506 being arranged to actuate the switch 612 in the circuit diagram, FIG. 13.

With the control member 506 in a right-hand position for indexing a right-hand cutter, the switch 612 is in a position energizing the solenoids 490 and 503 for indexing a cutter having right-hand teeth. When the control member 506 is in the opposite position, the switch 612 is thereby moved to a position energizing the solenoids 490 and 504 for indexing a cutter having left-hand teeth.

At each actuation of the limit switch 442 a timer relay 614 is activated and contacts 616 and 618 of the timer relay 614 initiate the circuit through contact 620, shown in FIG. 14, of relay 622 for the indexing of the cutter and the lowering of the grinding wheel.

The adjustment of the potentiometer 498 by manipulating the control member 497 on the control panel 481 determines the amount of index of the cutter through the timer 500 and contact relay 626. The closing of the contact 628 of the relay 626 effects momentarily energization of the solenoid operated valve 490 to cause the cutter to be indexed through a distance to move the succeeding cutter tooth into a position to be ground.

Actuation of the limit switch 442 also effects a minute lowering of the grinding wheel and its spindle 36 when the manually actuated on-off switch 632, shown in FIG. 14, is in closed position. The switch 632 may be controlled by the operator by a control member 633 on the control panel 481. The switch 632 has been previously closed by the operator before the automatic cycle is initiated by manipulating a button or control member 634 closing the switch 636, and manipulating the control member 518 on the control panel 481 to initiate automatic lowering of the grinding wheel at each reciprocation of the ram 26.

The automatic lowering of the grinding wheel is accomplished through a contact relay 640 and the solid state timer relay 517 through contact 644, the wheel being lowered through a very small distance at each reciprocation of the ram 26. The initiation of lowering the grinding wheel is effected by the closing of the limit switch 442 which, through contact 644 and contact 646, momentarily energizes solenoid operated valve 509 admitting oil to the hydraulic motor 210 to slightly lower the grinding wheel. The potentiometer 515 is adjusted by the control member 512 on the control panel 481 determining the amount of lowering movement of the grinding wheel at each reciprocation of the ram 26.

In a usual cutter grinding operation it is desirable to elevate the cutter or workpiece in successive steps of one or more thousandths of an inch at each grinding step. In the present arrangement the cutter supporting means is automatically elevated through a selected distance after the completion of each grinding step in which all of the teeth of the cutter are engaged by the grinding wheel. At the completion of a revolution of the cutter, the limit switch 522, shown in FIGS. 4 and 14, is closed mechanically and the relay contact 658 of a timer relay 659 energizes the timer relay 536.

The closing of the switch 522 energizes a circuit through the solid state timer relay 536 and timer contact 661 of the timer relay 536 and contact relay 662, a contact 663 of relay 662, and relay contacts 664, 665 and 666 to actuate the solenoid operated valve 526, shown in FIGS. 12 and 14, to direct oil to the hydraulically actuated motor 293 to rotate momentarily to feed the work table 230 upwardly through a distance for which the timer 536 has been adjusted. This step is repeated at each time the contact 658 is activated through the limit switch 522.

The total height that the work supporting fixture table 230 and the cutter mounted by the cutter support 385 is elevated is determined by the position of adjustment of cam-carrying member 333, shown in FIGS. 1 and 10. For example, if a total of nine thousandths of an inch is to be removed from the teeth of a cutter in three grinding steps the disc 330 carrying the abutment or cam 333 is adjusted by releasing the clamping member 327 and rotating the disc 330 through a circumferential distance of nine graduations on the periphery of the disc 330, each graduation being equivalent to elevating the work table 230 through a distance of one thousandths of an inch.

The potentiometer 534 connected with the solid state timer relay 536 is adjusted by the operator to a position indicating the thickness of material to be removed from the cutter during each revolution of the cutter. If the potentiometer 534 is adjusted by manipulating the control member 530 on the panel 481 to remove three thousandths of an inch from the teeth of the cutter at one grinding cycle, the work table 230 will be elevated a vertical distance of three thousandths of an inch after each grinding cycle of a cutter has been completed, and three grinding cycles would take place until the cutter is finally ground to the desired dimension. At the completion of the third step the limit switch actuator 333 carried by the disc 330 engages the limit switch 342 completing the grinding of the cutter as controlled by the timing relay 536.

The pressure fluid, such as oil, from the pump 451 is conveyed to the several solenoid operated valves through tubular means or flexible pipe 690, shown schematically in FIG. 12. A pressure gage 692, shown in FIG. 12, is connected with the tubular means 690. A return pipe or tubular means 694 returns the oil from the hydraulically actuated motors to the tank or reservoir 450. A filter 696 in the return line 694 filters out any foreign matter in the oil.

Connected with a portion 691 of the oil pressure line 690 is a relief valve 698 which may be adjusted to the desired pressure to be maintained in the hydraulic system. A tube or pipe 699 is connected with the relief valve and the return line 694 so that in event of excess pressure, oil is permitted by the relief valve to flow through the tube 699 for return to the tank 450.

The two-way solenoid operated valves for controlling pressure fluid flow to the rotary hydraulic motors 130, 406, 210 and 293 are conventional and of a character to selectively supply fluid under pressure for rotating the motors in one direction and for alternately supplying pressure fluid for rotating the motors in the opposite direction. The amount of pressure fluid directed to each of the motors is dependent upon the timing of the opening periods of the solenoid operated valves.

The electrical instrumentation shown in FIGS. 13 and 14 includes several contact relays which are of conventional construction. The solid state timing relays 500, 517 and 536 and the potentiometers 498, 515 and 534 associated with the timing relays are made by the Allen-Bradley Company of Milwaukee, Wis. and are Allen-Bradley units 800 T-U41.

In operating the apparatus to effect automatically the grinding of teeth of a right-hand cutter, the operator mounts the cutter C on the upper surface of the cutter mounting plate 385 in a conventional manner by a mandrel (not shown) extending through the center of the cutter and secured by the draw bar 417.

The operator closes the power supply switch 550 by depressing the button 553 on the panel 481. The operator then pressurizes the fluid system by closing the master start switch 562, shown in FIG. 13, by depressing the master start button 566 on the panel 481. The operator depresses the button 577 closing switch 576 initiating rotation of the motor 59 through the contacts 554, shown in FIG. 13, to rotate the wheel spindle 36 and the grinding wheel 40 in a proper direction to grind the teeth of a right-hand cutter.

If the teeth of a left-hand cutter are to be ground, the operator depresses the button 580 on the panel 481 which, through contacts 556, reverses the direction of rotation of the motor 59 for grinding the teeth of a left-hand cutter. To initiate automatic operation of the grinding apparatus, the operator depresses the member or button 589 on the control panel 481 which closes the switch 593 for initiating automatic operation.

Assuming that a right-hand cutter is to be ground, the operator moves the cutter indexing member 506 to a right-hand position. The operator adjusts the member 497 on the control panel member 481 which adjusts the pontentiometer 498, shown in FIG. 14, a distance slightly in excess of the distance of movement of the cutter to bring the succeeding tooth of the cutter in a position to be ground.

The operator adjusts the control member 512 on the panel 481 which adjusts the potentiometer 515, shown in FIG. 14, determining the distance that the grinding wheel is to be fed downwardly at each stroke of the ram 26 to engage the grinding wheel at each reciprocation of the ram with the wheel dressing tool 472, shown in FIG. 1, for dressing the wheel in preparation for the next grinding stroke of the wheel on a cutter tooth.

The operator adjusts the control member 530 on the panel 481 which adjusts the potentiometer 534, shown in FIG. 14, to preset the distance of elevation movement of the work table 230 and the cutter C mounted on the member 385 to the thickness of metal to be removed from each tooth of the cutter during a single revolution of the cutter. For example, the operator may adjust the potentiometer 534 to a position to remove three thousandths of an inch of metal from each of the cutter teeth during one revolution of the cutter.

The operator releases the locking member or knob 327, shown in FIGS. 1 and 10, and adjusts the position of the disc 330 carrying the limit switch actuator 333 to a position as indicated by graduations on the periphery of the disc 330 to determine the amount of total elevation of the work supporting table, work support member 385 and the cutter C to actuate the limit switch 342 to complete the grinding of a cutter.

For example, as previously mentioned, the cam 333 may be set for a total elevation of the cutter support of nine thousandths of an inch which would effect rotation of the cutter C through three revolutions with three thousandths of an inch of metal being removed from the cutter teeth at each revolution.

As shown in FIG. 1, the cutter C is disposed for rotation about a vertical axis. In event the cutter teeth are of a character to be ground with the cutter in an angular position, the clamping screw 373, shown in FIG. 6, may be released and the fixture 355 rotated to a different position for mounting a cutter and the clamping screw drawn up. The graduations on the portion 365 indicate the angularity of the axis of the cutter mounting member 385 relative to a vertical position.

The operator next depresses the cycle start button 601 which closes the switch 590. Assuming that limit switch 442 is closed and the solenoid activated valve 478, shown in FIGS. 12 and 13, is energized, pressure fluid is admitted to the ram actuating motor 130 which advances the ram 26 in a left-hand direction as viewed in FIG. 1 toward the grinding wheel.

As the ram 26 approaches the end of its advancing stroke, limit switch 441 is closed by actuator 444 activating the solenoid operated valve 484 directing pressure fluid to the ram-actuating motor 130 reversing the rotation of the motor to retract the ram. Upon retraction of the ram, the actuator 446 again closes the limit switch 442 and reciprocation of the ram continues.

The actuation of limit switch 442 energizes the solenoid actuated valves 490 and 503 which admit pressure fluid to the cutter-indexing hydraulic motor 406. The solenoid valves are opened an amount as determined by the setting of the potentiometer 498 and the timer 500 to index the cutter to bring the next succeeding tooth in a position to be engaged by the grinding wheel.

In event that a cutter having left-hand teeth is being ground, the manipulating member 506 on the panel 481 is in a left-hand position whereby the solenoid actuated valves 490 and 504 direct fluid to the motor 406 to reverse the direction of rotation of the motor for indexing a left-hand cutter in an amount to bring the next succeeding cutter tooth in a position to be engaged by the grinding wheel.

The actuation of the limit switch 442 energizes solenoid actuated valve 509, shown in FIG. 14, which admits pressure fluid to the hydraulic motor 210. The valve 509 is opened only momentarily as timed by the timer 517 to lower the grinding wheel a minute amount so that upon subsequent forward movement of the ram the grinding wheel engages the dressing tool 472 to prepare the wheel for engagement with the next succeeding tooth of the cutter.

Reciprocation of the ram continues automatically and at each reciprocation, the cutter is indexed through a distance of one tooth and the grinding wheel fed downwardly to dress the grinding wheel until the cutter has made a complete revolution and all of the teeth have been engaged by the grinding wheel.

At the completion of a revolution of the cutter, the limit switch 522, mounted on the fixture 355 and actuated by means (not shown) in the cutter mounting means or fixture 383, actuates solenoid operated valve 526 admitting pressure fluid to the motor 293 rotating the motor an amount as determined by the adjustment of the potentiometer 534 to elevate the table 230, fixture 355 and the cutter C preparatory to the next grinding cycle of all of the teeth on the cutter.

The previous grinding cycle is repeated comprising indexing the cutter, downfeeding the grinding wheel at each reciprocation of the ram, these actions being performed until the cutter rotates one complete revolution and all of the teeth are again engaged by the grinding wheel. At each upward movement of the table 230 and the fixture 355 by rotation of the screw 230, upward feeding occurs until the limit switch 342, shown in FIGS. 1 and 14, is engaged by the actuator or cam 333, the actuation of limit switch 342 determining the completion of the grinding cycles or processing operations on the cutter.

As herein mentioned, if nine thousandths of an inch of metal is to be removed from the teeth of the cutter, there will be three complete grinding cycles performed on the cutter prior to engagement of the cam 333 with the limit switch 342 opening the limit switch thus completing the grinding of the teeth of the cutter.

Provision is made to enable the operator to manually actuate control buttons on the panel 481 to thereby actuate solenoid operated valves for rapidly raising or rapidly lowering the spindle 36, spindle housing 34 and the grinding wheel 40, and for rapidly upfeeding or downfeeding of the table 230 and cutter supporting fixture 355 for purposes of changing grinding wheels and adjusting the position of a cutter in preparation for performing automatic grinding operations hereinbefore described.

For manual operation, the operator places the apparatus under manual control by depressing the control button 599 on the panel 481 which closes control switch 598, shown in FIG. 13. If the operator desires to rapidly raise the grinding wheel, the operator depresses the member or button 520 which closes the switch 650 energizing the solenoid actuated valve 510 to admit pressure fluid rapidly to the motor 210 for elevating the grinding wheel.

If the operator desires to rapidly lower the grinding wheel, the operator depresses the button 599 closing the switch 632 and depresses control button 518 closing the switch 636 which energizes solenoid actuated valve 654 and valve 510 allowing pressure fluid to bypass the valve 511. Through this action, the grinding wheel is fed rapidly downwardly.

If the operator desires to effect rapid elevation of the work supporting table 230 and the cutter mounting means 383, the button 599 on the control panel 481 is depressed after which the operator depresses the control button 670 actuating a switch 672 energizing solenoid operated valves 674 and 676, shown in FIGS. 12 and 14, allowing pressure fluid to flow through valve 676 and bypass the valve 528 which allows an increased flow of pressure fluid to the motor 293 to rapidly elevate the work table.

If it is desired to rapidly lower the work supporting table 230 and cutter support 383, the operator depresses the control button 680 on the panel 481 which closes switch 681 energizing the solenoid valve 676 admitting pressure fluid to the hydraulic motor 293 in the opposite direction thereby effecting a rapid lowering of the table and cutter supporting means.

The hydraulic actuated rotary motors 130, 210, 293 and 406 are of conventional construction and are manufactured by Lamina, Inc. of Royal Oak, Mich. The hydraulic motors 130, 210 and 293 are Lamina motors of its A-50 type and the cutter indexing motor 406 is Lamina's motor type A-25.

It is apparent that, within the scope of the invention, modifications and different arrangements may be made other than as herein disclosed, and the present disclosure is illustrative merely, the invention comprehending all variations thereof.

We claim:

1. Apparatus for performing processing operations in effecting the grinding of the teeth of a rotatable cutting tool including, in combination, a frame construction, a reciprocable ram mounted by the frame construction, means for reciprocating the ram including a driving shaft having a spiral recess, ball nut means mounted on the spirally recessed portion of the shaft for operative connection with the ram, said ball nut means having spiral grooves containing bearing balls adapted for traverse in the spiral recess on the shaft for transmitting rotation of the shaft for reciprocating the ram, a first hydraulically actuated rotary motor for rotating the shaft for reciprocating the ram, a rotatable shaft mounted by the ram for supporting a grinding wheel, an electrically energizable motor mounted by the ram for rotating the grinding wheel supporting shaft, said grinding wheel shaft being rotatable about an axis in a plane normal to the axis of reciprocation of the ram, a vertically movable table mounted by the frame construction, means mounted by the table adapted to mount the cutting tool, said means including a fixture rotatable about an axis, a member supporting the cutting tool mounted by the fixture and rotatable about an axis normal to the rotatable axis of the fixture, a second hydraulically actuated rotary motor for effecting vertical movement of the table, a third hydraulically actuated rotary motor for rotating the cutter supporting member for indexing the cutter to move successive teeth of the cutter into position to be engaged by the grinding wheel, means mounted by the frame for dressing the grinding wheel, a fourth hydraulically actuated rotary motor for moving the grinding wheel lengthwise of its axis of rotation to engage the grinding wheel with the dressing tool at each reciprocation of the ram, a supply of fluid under pressure, and valve means for effecting delivery of fluid to said hydraulically actuated rotary motors for actuating said motors.

2. Apparatus according to claim 1 wherein the valve means includes a first solenoid operated valve for effecting delivery of fluid to the first hydraulically actuated motor for effecting reciprocatory movements of the ram, and control means for said first solenoid operated valve including switch means actuated by the ram whereby the first solenoid operated valve directs pressure fluid to the first hydraulically actuated motor in alternate directions to effect reciprocation of the ram.

3. Apparatus according to claim 1 wherein the valve means includes a second solenoid operated valve for effecting delivery of fluid to the second hydraulically actuated motor for effecting vertical movement of the table, control means for said second solenoid operated valve including a first timer relay, and a first potentiometer connected with the first timer relay for determining the period of opening of said second solenoid operated valve for regulating the extent of each vertical movement of the table.

4. Apparatus according to claim 1 wherein the valve means includes a third solenoid operated valve for effecting delivery of fluid to the third hydraulically actuated motor for rotating the cutter supporting member for indexing the cutter to move successive teeth of the cutter into position to be engaged by the grinding wheel, control means for said third hydraulically actuated motor including a second timer relay, and a second potentiometer connected with said second timer relay for determining the period of opening of said third solenoid operated valve for regulating the extent of indexing rotation of the cutter to move the next successive tooth of the cutter in position to be engaged by the grinding wheel.

5. Apparatus according to claim 1 wherein the valve means includes a fourth solenoid operated valve for effecting delivery of fluid to the fourth hydraulically actuated motor for moving the grinding wheel lengthwise of its axis of rotation to engage the grinding wheel with the dressing tool at each reciprocation of the ram, control means for said fourth hydraulically actuated motor for moving the grinding wheel to engage the dressing tool including a third timer relay, and a third potentiometer connected with the third timer relay for determining the period of opening of the fourth solenoid operated valve for regulating the extent of movement of the grinding wheel toward the dressing tool at each reciprocation of the ram.

6. Apparatus for performing processing operations in effecting the grinding of the teeth of a rotatable cutting tool including, in combination, a frame construction, a reciprocable ram mounted by the frame construction, a rotatable shaft adapted to support a grinding wheel, a housing mounting the shaft and supported by the ram for movement relative to the ram, an electrically energizable motor for rotating the shaft for rotating the grinding wheel, means mounted by the frame construction for supporting a cutting tool to be ground, means for reciprocating the ram including a driving shaft having a spiral recess, ball nut means mounted on the spirally recessed portion of the shaft having operative connection with the ram, said ball nut means having spiral grooves containing bearing balls adapted for traverse in the spiral recess on the shaft for transmitting rotation of the shaft for reciprocating the ram, a hydraulically actuated rotary motor for rotating the shaft, solenoid operated valve means for directing fluid to the hydraulically actuated motor for rotating the motor, and control means for said solenoid operated valve means to effect flow of fluid in alternate directions to the hydraulically actuated motor for successively rotating the motor in opposite directions to effect reciprocation of the ram.

7. The combination according to claim 6 wherein the ball nut means includes two ball nuts each having a threaded tenon, the connection of the ball nuts with the ram including a projection on the ram, said projection having a threaded bore accommodating the threaded tenons on said ball nuts, the ball nuts being arranged at each side of the projection, a portion of the projection adjacent the threaded tenons having a kerf, and a bolt for securing the adjacent portions of the projection in clamping engagement with the threaded portions of the ball nuts.

8. The combination according to claim 6 including a second hydraulically actuated rotary motor, transmission gearing connecting said second hydraulically actuated motor and the housing supporting the grinding wheel shaft for effecting movement of said housing and shaft relative to said ram, solenoid operated valve means for controlling flow of fluid to said second hydraulically actuated motor for effecting relative movement of the housing supporting the grinding wheel shaft, electrically actuated means controlled by reciprocatory movements of the ram actuating the solenoid operated valve means to effect relative movement of the housing and the grinding wheel shaft, and means for adjusting the electrically actuated means for determining the period of opening of the solenoid operated valve for regulating the extent of relative movement of the housing and grinding wheel shaft at each reciprocation of the ram.

9. Apparatus for performing processing operations in effecting the grinding of teeth of a rotatable cutting tool including, in combination, a frame construction, means mounted by the frame construction for supporting the cutter to be ground, a reciprocable ram mounted by the frame construction, a housing mounted by the ram movable on an axis normal to the axis of the ram, a spindle journally supported by the housing and adapted to mount a grinding wheel, an electrically energizable motor mounted by the ram for rotating the spindle, means for reciprocating the ram including a driving shaft having a spiral recess, ball nut means mounted on the spirally recessed portion of the shaft for operative connection with the ram, said ball nut means having spiral grooves containing bearing balls adapted for traverse in the spiral recess on the shaft for transmitting rotation of the shaft for reciprocating the ram, a first hydraulically actuated rotary motor for rotating the shaft, a first solenoid operated valve means for controlling flow of fluid to rotate said first hydraulically actuated motor, means rendered effective by movement of said ram for controlling the operation of said first solenoid operated valve means to effect reciprocatory movements of the ram, means mounted by said frame construction for supporting a cutting tool adapted to be engaged by the grinding wheel, a second hydraulically actuated rotary motor, means including gearing for transmitting rotary movements of said second hydraulically actuated motor to said housing for moving said housing and grinding wheel spindle axially of the spindle, second solenoid operated valve means, and switch means actuated at each complete reciprocation cycle of the ram for actuating said second solenoid operated valve means to move said housing and grinding wheel toward the cutter to be ground.

10. Apparatus for performing processing operations in effecting the grinding of teeth of a rotatable cutting tool including, in combination, a frame construction, a reciprocable ram mounted by the frame construction, a housing mounted by the ram movable on an axis normal to the axis of the ram, a spindle journally supported by the housing and mounting a grinding wheel, an electrically energizable motor mounted by the ram for rotating the grinding wheel spindle, means for reciprocating the ram including a driving shaft having a spiral recess, ball nut means mounted on the spirally recessed portion of the shaft for operative connection with the ram, said ball nut means having spiral grooves containing bearing balls adapted for traverse in the spiral recess on the shaft for transmitting rotation of the shaft for reciprocating the ram, a first hydraulically actuated rotary motor for rotating the shaft, means rendered effective by reciprocatory movements of the ram for controlling the direction of rotation of said first hydraulically actuated motor to effect reciprocatory movements of the ram, means mounted by said frame construction for supporting a cutting tool adapted to be engaged by the grinding wheel, power transmission means including gearing for effecting vertical movement of said cutting tool supporting means, a second hydraulically actuated rotary motor actuating said gearing to position the cutting tool to be engaged by the grinding wheel, means including a limit switch operable upon completion of a cycle of grinding all of the teeth in the cutting tool for effecting actuation of the second hydraulically actuated rotary motor for elevating the cutter support means to effect a further cycle of grinding the teeth of the cutting tool, and adjustable means for regulating the extent of rotation of said second hydraulically actuated rotary motor to control the amount of elevation of the cutter tool support means for the succeeding grinding cycle.

11. Apparatus for performing processing operations in effecting the grinding of teeth of a rotatable cutting tool including, in combination, a frame construction, a reciprocable ram mounted by the frame construction, a housing mounted by the ram movable on an axis normal to the ram, a spindle journaled in the housing and adapted to mount a grinding wheel, an electrically energizable motor mounted by the ram for rotating the spindle, means for reciprocating the ram including a driving shaft having a spiral recess, ball nut means mounted on the spirally recessed portion of the shaft for operative connection with the ram, said ball nut means having spiral grooves containing bearing balls adapted for traverse in the spiral recess on the shaft for transmitting rotation of the shaft for reciprocating the ram, a first hydraulically actuated rotary motor for rotating the shaft for reciprocating the ram, a vertically movable table mounted by the frame, means for moving said table, a fixture mounted by the table, a cutting tool supporting means mounted by said fixture for rotation relative to the fixture, means for indexing the cutting tool and its supporting means after engagement of the grinding wheel with a tooth of the cutting tool to rotate the cutting tool to a position for the grinding wheel to engage the next succeeding tooth on the cutting tool, said indexing means including a second hydraulically actuated rotary motor mounted by said fixture for rotating the cutter to successive positions, solenoid operated valve means for controlling flow of fluid to said second hydraulically actuated rotary motor for indexing the cutting tool, means including a timer relay rendered operable by reciprocatory movement of the ram for actuating the solenoid operated valve means, and a potentiometer connected with the timer relay for determining the amount of indexing rotary movement of the cutting tool supporting means and the cutting tool to bring the next succeeding tooth of the tool into position to be engaged by the grinding wheel.

* * * * *